US010184700B2

(12) United States Patent
Cochran et al.

(10) Patent No.: US 10,184,700 B2
(45) Date of Patent: Jan. 22, 2019

(54) OIL RETURN SYSTEM AND METHOD FOR ACTIVE CHARGE CONTROL IN AN AIR CONDITIONING SYSTEM

(75) Inventors: Robert W. Cochran, Lakeland, FL (US); Ricardo Cruz, Lakeland, FL (US)

(73) Assignee: TOTAL GREEN MFG. CORP., St. Henry, OH (US)

( * ) Notice: Subject to any disclaimer, the term of this patent is extended or adjusted under 35 U.S.C. 154(b) by 2453 days.

(21) Appl. No.: 12/701,920

(22) Filed: Feb. 8, 2010

(65) Prior Publication Data

US 2010/0218522 A1 Sep. 2, 2010

Related U.S. Application Data

(60) Provisional application No. 61/150,815, filed on Feb. 9, 2009.

(51) Int. Cl.

| | |
|---|---|
| ***F25B 1/00*** | (2006.01) |
| ***F25B 43/02*** | (2006.01) |
| ***F25B 41/00*** | (2006.01) |
| ***F25B 31/00*** | (2006.01) |
| ***F25B 43/00*** | (2006.01) |

(52) U.S. Cl.

CPC ..... *F25B 31/004* (2013.01); *F25B 43/006* (2013.01)

(58) Field of Classification Search

CPC ..... F25B 43/006; F25B 31/004
USPC ..... 62/192, 468, 472, 503
See application file for complete search history.

(56) References Cited

U.S. PATENT DOCUMENTS

| | | | | |
|---|---|---|---|---|
| 1,899,378 | A * | 2/1933 | Zouck | F25B 31/004 62/471 |
| 2,223,882 | A * | 12/1940 | Beline | F25B 31/004 137/237 |
| 2,299,811 | A | 10/1942 | Feicht | |
| 2,461,342 | A | 2/1949 | Obreiter, Jr. | |
| 2,476,044 | A | 7/1949 | Kals | |

(Continued)

FOREIGN PATENT DOCUMENTS

| | | |
|---|---|---|
| JP | 2574832 | 1/1997 |
| JP | 10141813 | 5/1998 |
| JP | 2008193759 | 8/2008 |

*Primary Examiner* — Len Tran
*Assistant Examiner* — Kirstin Oswald
(74) *Attorney, Agent, or Firm* — Allen Dyer Doppelt & Gilchrist

(57) ABSTRACT

An active charge control (ACC) in an air conditioner has a first portion of refrigerant passing into a compressor and a second portion held within the ACC. The first portion is substantially vapor and the second portion substantially liquid. Lubricant is included in both portions for lubricating the compressor. A lubricant mechanism includes a heat exchanger having a primary pathway thermally connected with the compressor and a secondary pathway operable between the ACC and the compressor. The secondary pathway transfers the refrigerant second portion to the compressor. The fluid inlet of the compressor retains liquid refrigerant. The secondary pathway delivers the refrigerant and the lubricant from the ACC to the compressor such that heat energy from the primary pathway is transmitted to the liquid refrigerant and lubricant in the secondary pathway evaporating the refrigerant in the secondary pathway such that refrigerant vapor and lubricant are sent to the compressor.

10 Claims, 7 Drawing Sheets

(56) References Cited

U.S. PATENT DOCUMENTS 2,617,265 A * 11/1952 Ruff ..... F25B 31/004 62/192
2,721,728 A * 10/1955 Higgins ..... F25B 27/00 165/104.25
2,859,596 A 11/1958 Evans
2,901,894 A 9/1959 Zearfoss, Jr.
2,977,773 A 4/1961 De Kanter
3,012,414 A 12/1961 La Porte
3,491,544 A 1/1970 Webber
3,600,904 A * 8/1971 Tilney ..... F25B 41/065 62/136
3,714,028 A * 1/1973 Hallman ..... C10G 45/22 208/111.3
3,785,169 A * 1/1974 Gylland, Jr. ..... F04B 39/0207 62/468
4,006,602 A 2/1977 Fanberg
4,030,315 A * 6/1977 Harnish ..... F25B 13/00 62/324.4
4,066,869 A * 1/1978 Apaloo ..... F04B 39/0207 184/104.1
4,187,695 A 2/1980 Schumacher
4,299,098 A 11/1981 Derosier
4,798,058 A * 1/1989 Gregory ..... F25B 47/022 165/154
5,042,271 A * 8/1991 Manz ..... F25B 43/02 62/470
5,265,437 A 11/1993 Saperstein et al.
5,461,876 A 10/1995 Dressler
5,561,985 A 10/1996 Cochran
5,613,368 A 3/1997 Marohl et al.
5,622,055 A 4/1997 Mei et al.
2,887,444 A 3/1999 Toyoshima et al.
5,887,441 A 3/1999 Spauschus et al.
6,343,486 B1 2/2002 Mizukami
6,457,325 B1 * 10/2002 Vetter ..... F25B 31/004 62/473
6,467,300 B1 10/2002 Noble
6,694,766 B1 2/2004 Johnson, Jr. et al.
7,080,524 B2 7/2006 Wiggs
7,086,240 B1 8/2006 Zugibe et al.
7,111,472 B1 9/2006 Cloud
7,578,140 B1 * 8/2009 Wiggs ..... F25B 30/06 165/45
2005/0262873 A1 12/2005 Hirota
2006/0075775 A1 4/2006 Boiarski et al.
2008/0223073 A1 * 9/2008 Fralick ..... F25B 43/006 62/503
2008/0282713 A1 11/2008 Anderson et al.
2009/0120120 A1 * 5/2009 Wiggs ..... F25B 43/006 62/260
2011/0120154 A1 * 5/2011 Woolley ..... F01D 25/20 62/84

* cited by examiner

OIL RETURN SYSTEM AND METHOD FOR ACTIVE CHARGE CONTROL IN AN AIR CONDITIONING SYSTEM

CROSS-REFERENCE TO RELATED APPLICATION

This application claims the benefit of and priority to Provisional Application Ser. No. 61/150,815 having filing date of Feb. 9, 2009 for "Oil Return Mechanism For Active Charge Control In An Air Conditioning System, the disclosure of which is incorporated herein by reference in its entirety, and commonly owned.

FIELD OF INVENTION

The present invention generally relates to air conditioning and heating systems and in particular to compressor lubrication.

BACKGROUND

In refrigeration circuits, some of the oil that lubricates the compressor is entrained in the vapor pumped by the compressor, and the oil circulates throughout the refrigerant circuit. Most refrigerant compressors require the lubricant to reduce friction and help to seal the compression cylinder or cavity. Inevitably, some of the lubricating oil is drawn into the refrigerant vapor stream and circulates throughout the refrigerant circuit and back to the compressor if nothing traps the oil along the way. In conventional refrigerant circuits, the vessel just upstream from the compressor is the "accumulator", potentially the most likely place for oil to be trapped. But this is typically circumvented by the use of an "oil return hole" near the bottom of the tube that serves as the outlet of the accumulator. While this returns the oil to the compressor, liquid refrigerant can not be stored in the accumulator, as it also would leave by way of the oil return hole. The accumulator is an interesting misnomer in that the typical accumulator can only accumulate liquid briefly, as any liquid refrigerant quickly leaves via an oil return hole.

In circuits using an active charge control (ACC), the oil must be transported through the ACC to the compressor. In a typical ACC, at least one dimension is critical to proper oil return from the ACC to the compressor. If the dimensions within the ACC are not well matched to the size and loading of the compressor, insufficient oil transport from the ACC to the compressor can result.

By way of example, it is desirable to store all inactive liquid refrigerant in the ACC. Refrigerant arriving at the ACC is primarily vapor, but may also include liquid. In either state oil is either entrained in the vapor, or dissolved in the liquid. The vaporized refrigerant passes on through the ACC, but a significant portion of the oil clings to the ACC walls and is trapped there. Liquid arriving at the ACC is trapped there, including the oil dissolved therein.

In circuits using an active charge control (ACC), the oil must be transported through the ACC to the compressor. It has been necessary to provide means of moving oil trapped in the ACC on to the compressor. This was done with a system of splash plates and exit clearances, which caused the oil to become a fine-droplet mist or a tiny bubble consisting of oil surrounding a tiny bit of vapor. The mist and/or bubbles were then entrained in the vapor stream and carried on to the compressor. The problem with this method of oil return is that it is sensitive to the velocity of the refrigerant passing through the ACC, the area of the exit clearance, and even the type of oil used in the system. Careful matching of the compressor and the ACC was required.

As above addressed, and as is well known in the art, typical ACC dimensions are critical to proper oil return from the ACC to the compressor. If the dimensions within the ACC are not well matched to the size and loading of the compressor, insufficient oil transport from the ACC to the compressor can result.

SUMMARY

The present invention is directed to air conditioning systems and methods. In a refrigerant circuit containing a compressor, a condenser, an evaporator, a liquid flow control, and an active charge control (ACC), an oil return mechanism operable with the compressor may comprise a heat exchanger including a primary fluid pathway and a secondary fluid pathway, a conduit placing the outlet of the condenser in fluid communication with the primary pathway of the heat exchanger to provide flow of fluid from the condenser through the primary pathway of the heat exchanger, and conduit connecting the ACC in fluid communication with the inlet of the secondary pathway of the heat exchanger and connecting the outlet of the secondary pathway in fluid communication with the compressor inlet to provide a flow of fluid from the ACC, through the secondary pathway and on to the compressor inlet, such that heat energy from the liquid flowing through the primary pathway is transmitted to the refrigerant and oil mix in the secondary pathway and evaporates the refrigerant in the secondary pathway to send refrigerant vapor and compressor oil on to the compressor inlet.

An embodiment of the oil return mechanism may include a vent tube bridging across an elevated portion of the compressor inlet tube to equalize the pressures in the compressor and ACC and to prevent transfer of the refrigerant and oil mix from the ACC to the compressor during the off-cycle of the refrigerant circuit system. The oil return mechanism may include a compressor heater to heat the compressor during the system off-cycles and to prevent refrigerant from condensing in the compressor during off-cycles and to prevent liquid refrigerant from being transferred from the ACC to the compressor during off-cycles of the refrigerant system. The oil return mechanism may include a slotted outlet tube for expediting the return of oil that may stratify and float on top of the refrigerant and oil mix in the ACC. Yet further, embodiments of the oil return mechanism may include one of or any combination of the vent tube, the compressor heater and the slotted outlet tube.

Yet further, the oil return mechanism may include relocating the ACC evaporator tube external to the ACC vessel to further simplify the ACC function and reduce the cost of production of the refrigerant system, and may include the oil return mechanism having one of or any combination of the vent tube, the compressor heater, and the slotted outlet tube. In a refrigerant circuit containing a compressor, a condenser, an evaporator, a liquid flow control, and an active charge control (ACC), an oil return mechanism may comprise a pathway from the near-bottom of the ACC to the compressor inlet with a method aspect of the invention that may include placing a small liquid outlet near a bottom portion of the ACC outlet in fluid communication with the compressor inlet, using a conduit sized to allow approximately 1% to 3% of the refrigerant arriving at the ACC from the system evaporator to flow from the near-bottom of the ACC through the pathway to the compressor, placing the conduit, or secondary pathway of the heat exchanger in thermal contact with a heat source sufficient to completely evaporate all the refrigerant passing through the pathway, such that refrigerant vapor and compressor oil will be delivered to the compressor inlet. Yet further, the method may comprise at least one of the condenser and the evaporator having at least one earth loop conduit extending down into the earth in a loop borehole, trench or pit, the earth loop extending into the borehole comprising at least two tubes joined in fluid communication at their distal ends.

The oil return mechanism (ORM) of the present invention is desirably less sensitive to the typical variables presented in the art as addressed above. Embodiments of the invention operate on a principle of physically removing oil from the ACC by constantly draining a small portion of the liquid and oil mix in the ACC and sending it on to the compressor by way of a heat exchanger, which heat exchanger serves to evaporate the refrigerant in the drained mix, and send the vapor and separated oil on to the compressor. By sending the liquid/oil mix through the heat exchanger, sending liquid refrigerant directly into the compressor is desirably avoided.

By way of example, the amount of the drained mix is approximately 1 to 3 percent of the total refrigerant circulating through the system. If the system is circulating, say, 500 pounds per hour of refrigerant, the oil return mix might be on the order of 6 or 7 pounds per hour. The amount of mix normally in the ACC might be on the order of about 8 or 9 pounds, thus the mix in the ACC gets it's oil removed about every hour or two. The ACC, by its very nature, demands that a small amount of liquid, same as the amount drained by the ORM, is constantly trapped by the ACC.

A motivating force that moves the oil return mix is first the "vertical head" of the liquid in the ACC, as the mix is drawn from near the bottom of the ACC, and the ACC normally operates about half full of liquid. At the other end, a Venturi serves to "suck" the oil and vapor into the entrance pipe of the compressor, just upstream from the compressor. The compressor entrance tube may be shaped to be close to a floor at a point where it is penetrated by a Venturi for the ORM.

BRIEF DESCRIPTION OF DRAWINGS

For a fuller understanding of the invention, reference is made to the following detailed description, taken in connection with the accompanying drawings illustrating various embodiments of the present invention, in which.

DETAILED DESCRIPTION OF EMBODIMENTS

The present invention will now be described more fully with reference to the accompanying drawings and photos in which alternate embodiments of the invention are shown and described. It is to be understood that the invention may be embodied in many different forms and should not be construed as limited to the illustrated embodiments set forth herein. Rather, these embodiments are provided so that this disclosure may be thorough and complete, and will convey the scope of the invention to those skilled in the art.

It will be appreciated that embodiments of the invention comprise oil return mechanisms differing from the typical ACC, and are effective over a much wider range of compressor sizes and loadings. Additionally with the oil return mechanisms of the present invention, the ACC is a much simpler mechanism and thus more commercially desirable.

Figure 1:
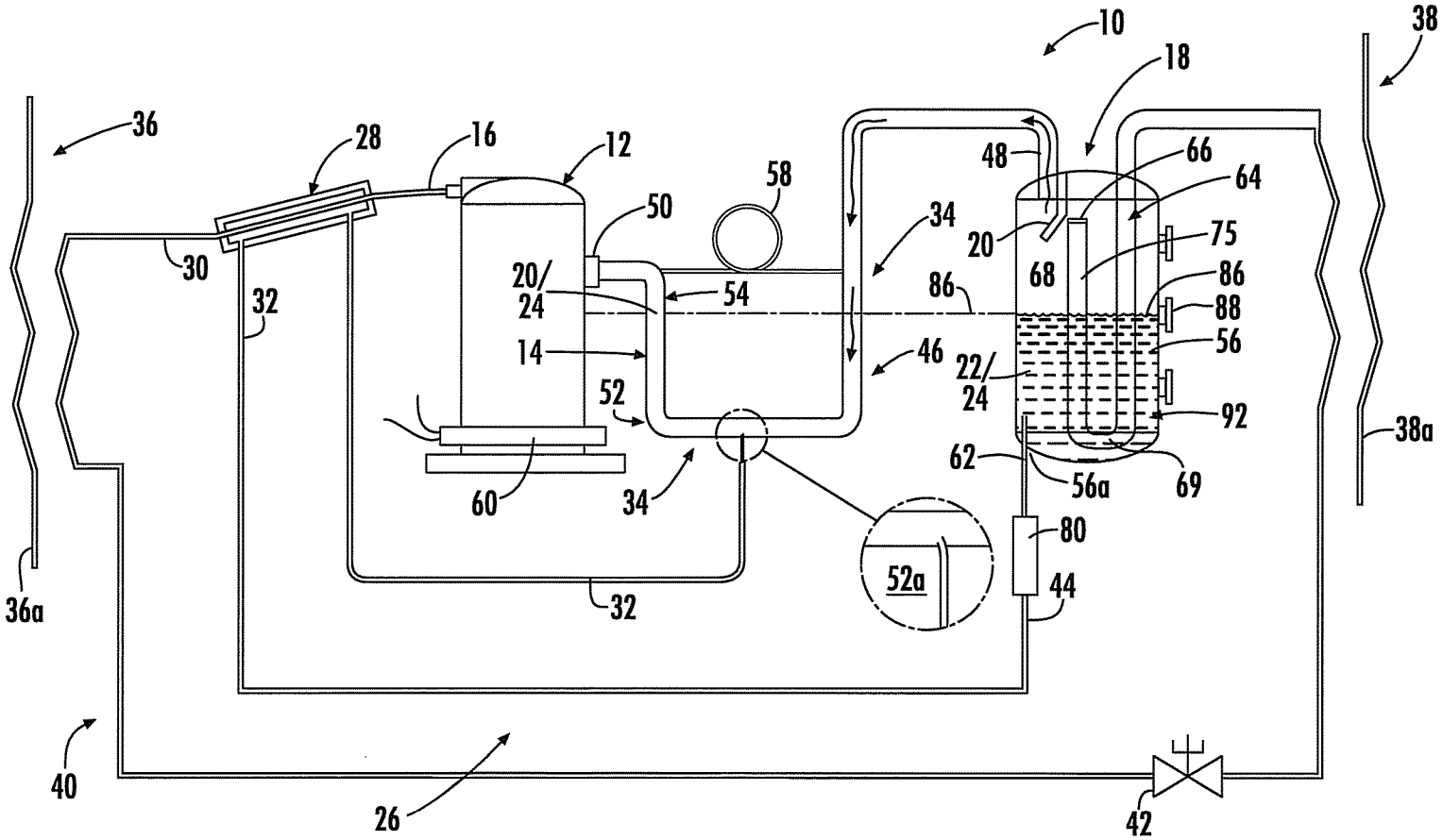
FIG. 1 is a diagrammatical illustration of one air conditioning system including an active charge control and oil return mechanism in keeping with the teachings of the present invention.

With reference initially to FIG. 1, an air conditioning system 10 in keeping with the teachings of the present invention is herein described, by way of example, to include a compressor 12 having a fluid inlet 14 and a fluid outlet 16. An active charge control (ACC) 18 is operable with the compressor 12 and includes a first portion 20 of fluid passing from the ACC to the compressor and a second portion 22 of the fluid contained in the ACC. The first portion 20 of the fluid is substantially vapor refrigerant and the second portion 22 of the fluid is substantially liquid refrigerant and compressor lubricant (typically an oil) 24. Both the first and second portions 20, 22 comprise the lubricant 24 for lubricating the compressor 12, the first portion 20 generally carrying an insufficient amount of lubricant 24 to adequately lubricate the compressor 12.

As illustrated by way of example with reference to FIG. 1, one embodiment of the invention includes a lubricant return mechanism 26 including a heat exchanger 28 having a primary pathway 30 in thermal communication with the compressor 12 and a secondary pathway 32 operable between the ACC 18 and the fluid inlet 14 of the compressor 12, the secondary pathway transferring some of the second portion 22 of the fluid contained in the ACC to the fluid inlet of the compressor. The fluid inlet 14 of the compressor 12 includes means 34 for retaining liquid refrigerant during an off cycle of the system. The secondary pathway 32 delivers liquid refrigerant and the lubricant from the ACC 18 to the heat exchanger inlet, and lubricant and vapor continues on to the inlet 14 of the compressor 12 such that heat energy from the primary pathway 30 is transmitted to the liquid refrigerant and lubricant in the secondary pathway 32 evaporating the refrigerant in the secondary pathway to send refrigerant vapor and the lubricant to the compressor inlet 14, and then to the compressor inlet port 50.

With continued reference to FIG. 1, the system 10 may further be described as comprising a condenser 36 and fluid control device 42 operable downstream the compressor 12. An evaporator 38 is operable downstream the condenser 36 and is also operable with the ACC 18, wherein the compressor, the condenser, the evaporator, liquid flow control device, and the ACC form a circuit 40 of the system 10. The primary pathway 30 of the heat exchanger 28 is within the circuit 40. In addition, the flow control device 42, operable within the circuit 40, provides for a flow of fluid from the compressor 12 through the primary pathway 30 of the heat exchanger 28. For embodiments of the invention, at least one of the condenser and the evaporator may include at least one looped conduit 36*a*, 38*a* extending into earth.

With continued reference to FIG. 1, a restrictor 44 is operable within the secondary pathway 32 of the heat exchanger 28. The restrictor 44 sufficiently restricts fluid flow for providing controlling a preselected amount of fluid flowing through the secondary pathway. Alternatively, secondary pathway 32 may be sized to provide the desired flow, thus eliminating a need for the restrictor 44.

As illustrated with continued reference to FIG. 1, the fluid inlet 14 of the compressor 12 comprises an arcuate portion, herein a generally U-shaped portion 46 between a vapor outlet 48 of the ACC 18 and an inlet port 50 of the compressor 12. The U-shaped portion 46 has a lower portion 52 that may contain the liquid refrigerant when the system 10 is in an off condition, and generally when there is no provision for heating the compressor. The U-shaped portion 46 includes an upper portion 54 through which flows the vapor refrigerant and the lubricant. Operation of the system generally provides that the compressor inlet 14 substantially contains the vapor refrigerant and the lubricant. As illustrated, the secondary pathway 32 of the heat exchanger 28 is connected 52*a* between the lower portion 52 of the fluid inlet 14 of the compressor 12 and connected 56*a* at a bottom portion 56 of the ACC 18 having the liquid refrigerant 22 and the lubricant 24 contained therein.

With continued reference to FIG. 1, a vent tube 58 connects elevated portions of the inlet 14 of the compressor 12 to equalize pressure within the compressor with pressure within the ACC 18, and thus prevent transfer of the liquid refrigerant and oil from the ACC to the compressor during an off-cycle of the system.

Optionally, a heater 60 may be operable with the compressor 12 for heating the compressor at least during a system off-cycle, thus preventing refrigerant from condensing in the compressor during the off-cycle and to prevent liquid refrigerant from being transferred from the ACC 18 to the compressor during the off-cycle of the system 10.

With further regard for the ACC 18, and with continued reference to FIG. 1, an outlet tube 62 carried within the ACC is connected to the secondary pathway 32 of the heat exchanger 28, wherein the outlet tube includes slots therein sufficient for expediting the return of oil that may stratify and float on top of a liquid refrigerant and lubricant mix contained in the ACC 18.

In one embodiment as further illustrated with reference to FIG. 1, the ACC 18 comprises a generally U-shaped inlet tube 64 carried within the ACC, wherein an outlet port 66 of the generally U-shaped inlet tube is positioned above the liquid contained in the ACC 18. A deflector 68 is positioned proximate the outlet port 66 for sufficiently deflecting liquid being received by the ACC 18. The inlet 64 of the ACC is positioned at a top portion thereof, thus providing enhanced thermal contact between the refrigerant flowing through the ACC 18 and the liquid refrigerant and lubricant mix 22/24 within the ACC. As further illustrated with reference to FIG. 1, a hole 69 may be provided near a bottom portion of the inlet tube 64 such that refrigerant and lubricant mix 92 may be drawn into a rising portion 75 to circulate the liquid mix within the ACC 18 to increase thermal contact between the mix 92 (20/24) and the vapor passing through the ACC.

Figure 2:
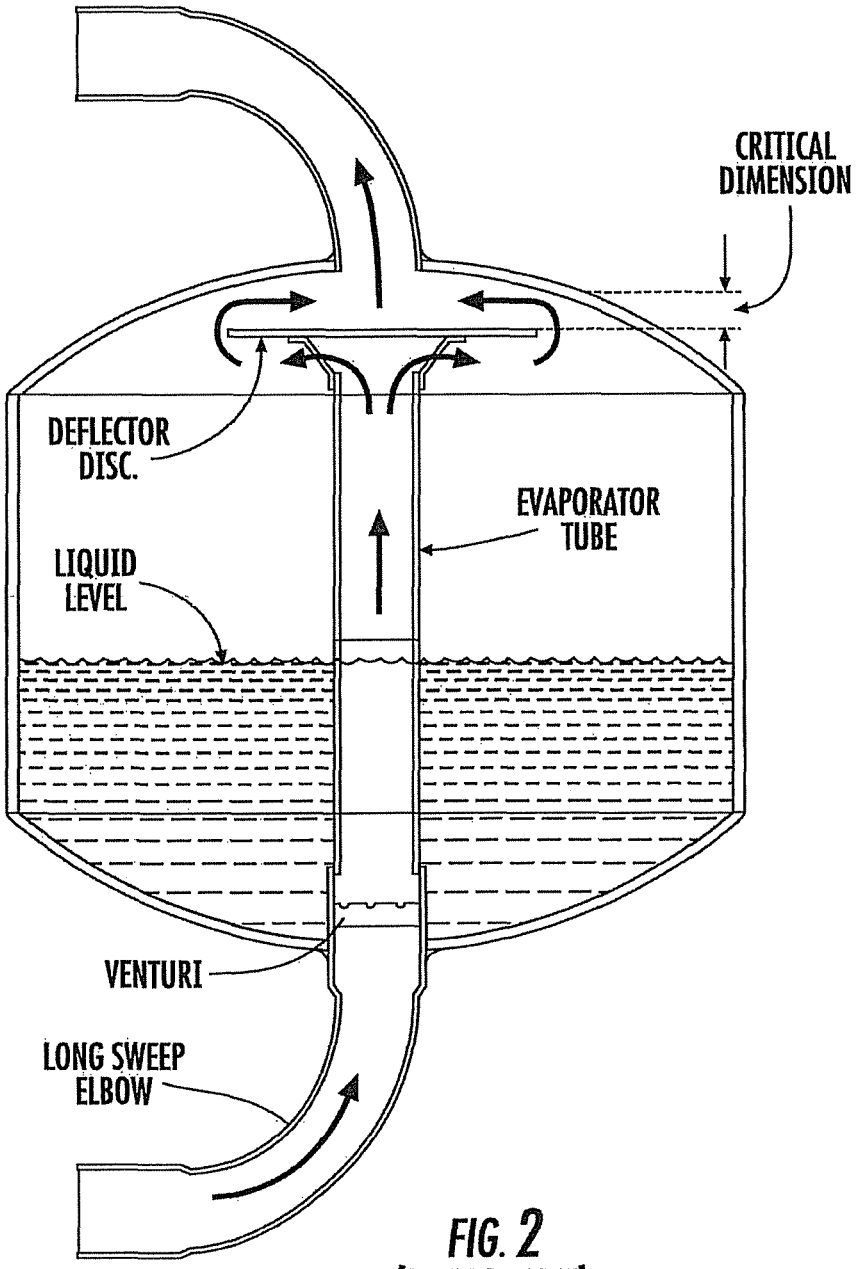
FIG. 2 (PRIOR ART)
FIG. 2 is a partial diagrammatical illustration typical of one known active charge control.

With reference to FIG. 2 for a typical construction of an ACC, vapor and liquid refrigerant are deflected by a deflector disc. The compressor lubricant, such as oil, is entrained in both the liquid and vapor. Oil mist and tiny bubbles made of oil and vapor are drawn upward around the periphery of the deflector disc and exit the vessel along with the main flow of vapor. Liquid refrigerant and bubbles laden with liquid refrigerant fall down into the reservoir. If a dimension between the disk and the outlet, a "critical dimension" illustrated in FIG. 2, is too large, the velocity of the main vapor flow will be so slow that the oil will not be carried up and out of the vessel to return to the compressor, with the result that oil may be trapped in the ACC, and the compressor may become starved of oil and fail. Conversely, if the critical dimension is too small, some liquid refrigerant may be entrained in the main vapor stream and carried on to the compressor. This is detrimental to the compressor, and may even cause the compressor to fail. Even lightly loading of et compressor can result in insufficient transfer of oil from the ACC to the compressor. Those of skill in the art will appreciate that such will not be the case for embodiments of the invention as above described with reference to FIG. 1 and to the following embodiments, herein presented by way of further example.

In one embodiment of the invention, illustrated with reference now to FIG. 3, the air conditioning system 10A includes the lubricant or oil return mechanism 26 completely external to the ACC 18, as was described for the system 10, thus leaving no critical dimension for concerns. For the embodiment illustrated with reference to FIG. 3, the heat exchanger 28 is located downstream the condenser 36. The heat exchanger 28 includes the primary pathway 30 and the secondary pathway 32, wherein liquid refrigerant is carried by a tube 70 of the primary pathway from the condenser 36 and traverses into an outer tube 72 of the heat exchanger 28. The space between the outside of tube 70 and the tube 72 forms a portion of the secondary pathway 32. Those of ordinary skill in the art will appreciate that other forms of heat exchangers may be used now having the benefit of the teachings of the present invention.

Figure 3:
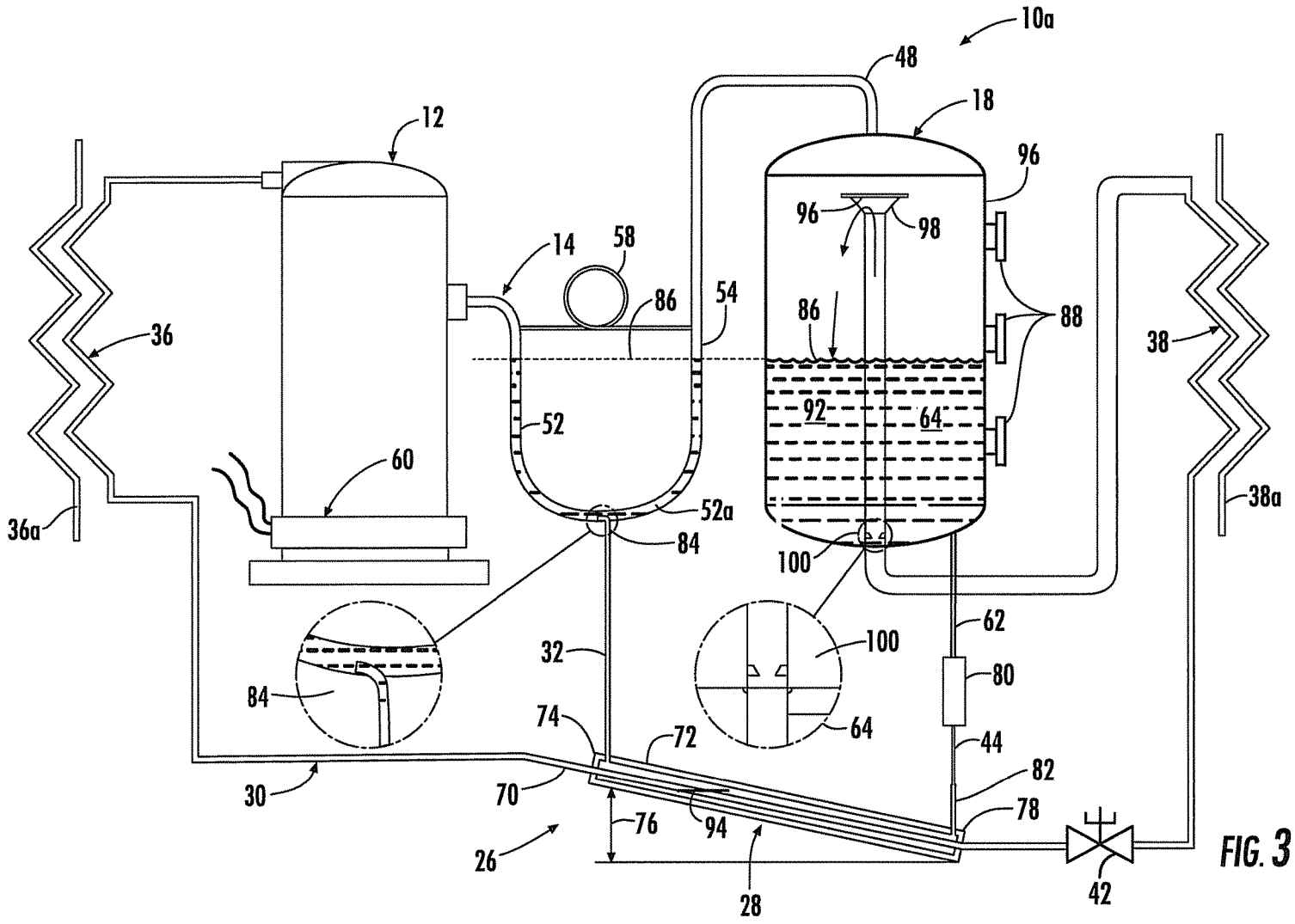
FIGS. 3-6 are diagrammatical illustrations of alternate embodiments of the present invention.

With continued reference to FIG. 3, the end 74 of the heat exchanger 28 nearest the condenser 36 may be elevated 76 relative to the end 78 of the heat exchanger nearest to the liquid flow control device 42. Any amount of elevation 76, from zero (horizontal) to vertical, could be used, but an elevation of about 30 degrees provides a means of insuring that only refrigerant vapor and oil can return to the compressor 12. Also, the heat exchanger 28 as herein illustrated by way of example, is in a "counter flow" configuration. A "parallel flow" configuration will also work, but may not be as efficient.

With continued reference to FIG. 3, the outlet tube 62, earlier described with reference to FIG. 1, is inserted into a near-bottom of the ACC 18. A strainer 80 may be connected between the outlet tube 62 and the restrictor 44 for connection of the near-bottom of the ACC 18 into fluid communication within the secondary pathway 32. As above described, the restrictor 44 includes a tube sized to control the rate of flow of liquid from the ACC 18 to the heat exchanger 28. The outlet tube 62 or tubing 82 within the secondary pathway may be sized to control the rate of flow of liquid from the ACC 18 for eliminating a need for the separate restrictor 44. Other forms of restrictors, such as a fixed orifice or an adjustable valve may be used. Also, the strainer 80 is not essential to the operation of the oil return mechanism, but is added as a precaution in the event that undesirable debris or trash blocks flow through the fluid pathway 32.

By way of example, the restrictor 44 may be sized such that a small amount of the liquid refrigerant, less than 5% (and likely only about 1% to 3%). traversing the system evaporator 38 is returned to the compressor 12 by way of the secondary pathway 32 and the heat exchanger 28. By constantly removing a small portion of the concentrated refrigerant/oil mix, the concentration of oil in the mix is constantly reduced until equilibration is reached and the level of oil in the compressor is stabilized at a desired level. In effect, the liquid/oil mix in the ACC 18 is changed out about once every one or two hours, depending on compressor size and loading and on the size of the ACC vessel. Therefore, the relative small amount of liquid refrigerant that passes through the secondary pathway 32 is vaporized by the heat exchanger 28 and is entered into the system at the compressor inlet 14.

With continued reference to FIG. 3, the secondary pathway 32 of the upper end 74 of the heat exchanger 28 is connected in fluid communication with an inlet port 84 formed within the inlet 14 of the compressor 12. Consistent with that described with reference earlier to FIG. 1, the inlet port 84 is lower in elevation than the liquid level 86 in the ACC 18, as also illustrated with reference to FIG. 1. The liquid level 86 may optionally be viewed through viewing ports 88 located within a sidewall 90 of the ACC 18. This difference in elevation, together with any reduced pressure that may be created by the inlet port 84, provides a pressure differential which causes liquid refrigerant and oil mix 92 to be drawn from the near-bottom of the ACC 18 through the above named tubes, strainer and restrictor, through the heat exchanger and on to the inlet port 84. Thus a fluid path is created from the bottom of the ACC 18 to the inlet of the compressor 12.

In operation, the liquid in the ACC 18 is colder than the liquid coming out of the condenser 12. Therefore, there is a temperature differential between the primary pathway 30 and the secondary pathway 32 of the heat exchanger 28. Because of the pressure differential and temperature differential, the liquid refrigerant mixed with compressor oil leaves the ACC 18, enters the secondary pathway space within the heat exchanger 28, and evaporates as it moves toward the raised end 74 of the heat exchanger. Heat energy in primary pathway 30 is transferred to the secondary pathway 32 to evaporate the liquid refrigerant in the secondary pathway 32 within the heat exchanger 28. When the liquid refrigerant completes evaporation in the heat exchanger 28, at varying levels 94, illustrated with reference again to FIG. 3, this leaves only compressor oil and superheated refrigerant vapor coming out of the heat exchanger 28 within the secondary pathway 32 and into the inlet port 84, and then via the inlet tube 14 into the compressor 12.

With continued reference to FIG. 3, separating the lubricant return mechanism 26 from the ACC 18 makes the ACC easier and simpler to construct, as there are no precision clearances required. For the ACC 18 including a deflector disc 96, supported by bracket 98, the deflector disc can be desirably much smaller in diameter than is typical in an ACC, as its only function is to deflect the liquid mix 92 circulating through the inlet tube 64 of the ACC 18 and possibly a Venturi 100. Further, any liquid arriving from the evaporator 38 and exiting the ACC inlet tube 64 falls into the refrigerant/oil mix 92, as herein illustrated. This prevents any liquid from leaving the ACC 18 via the outlet 48 and on to the compressor inlet 14.

When the refrigerant circuit is shut down, the liquid mix 92 traverses through the strainer, restrictor, heat exchanger, connecting tubes and inlet port, and fills the lower portion of the compressor inlet tube until the liquid levels in the tube are at the same elevation as the liquid level in the ACC. As the off-cycle continues, the ACC and its contents warm up and the pressure in the ACC increases. At the same time, the compressor cools off and the pressure in the compressor decreases. In systems that have a long off-cycle, it is possible that this increasing pressure differential causes an excess of liquid mix to be transferred into the compressor during the off cycle. As above described with reference to FIG. 1, and as further illustrated with reference again to FIG. 3, to prevent this from happening, the small vent tube 58 serves to continuously equalize the pressures in the compressor and the ACC, and prevents the transfer of liquid from the ACC to the compressor. Alternatively, a "Belly Band" heater, such as the heater 60, above described, and well known to those skilled in the art of refrigerant circuits, may be applied to the compressor 12 to keep the compressor warmer than the ACC 18. Compressors may be used that have a built-in heater. The application of a compressor heater can make use of the vent tube 58 optional.

Figure 4:
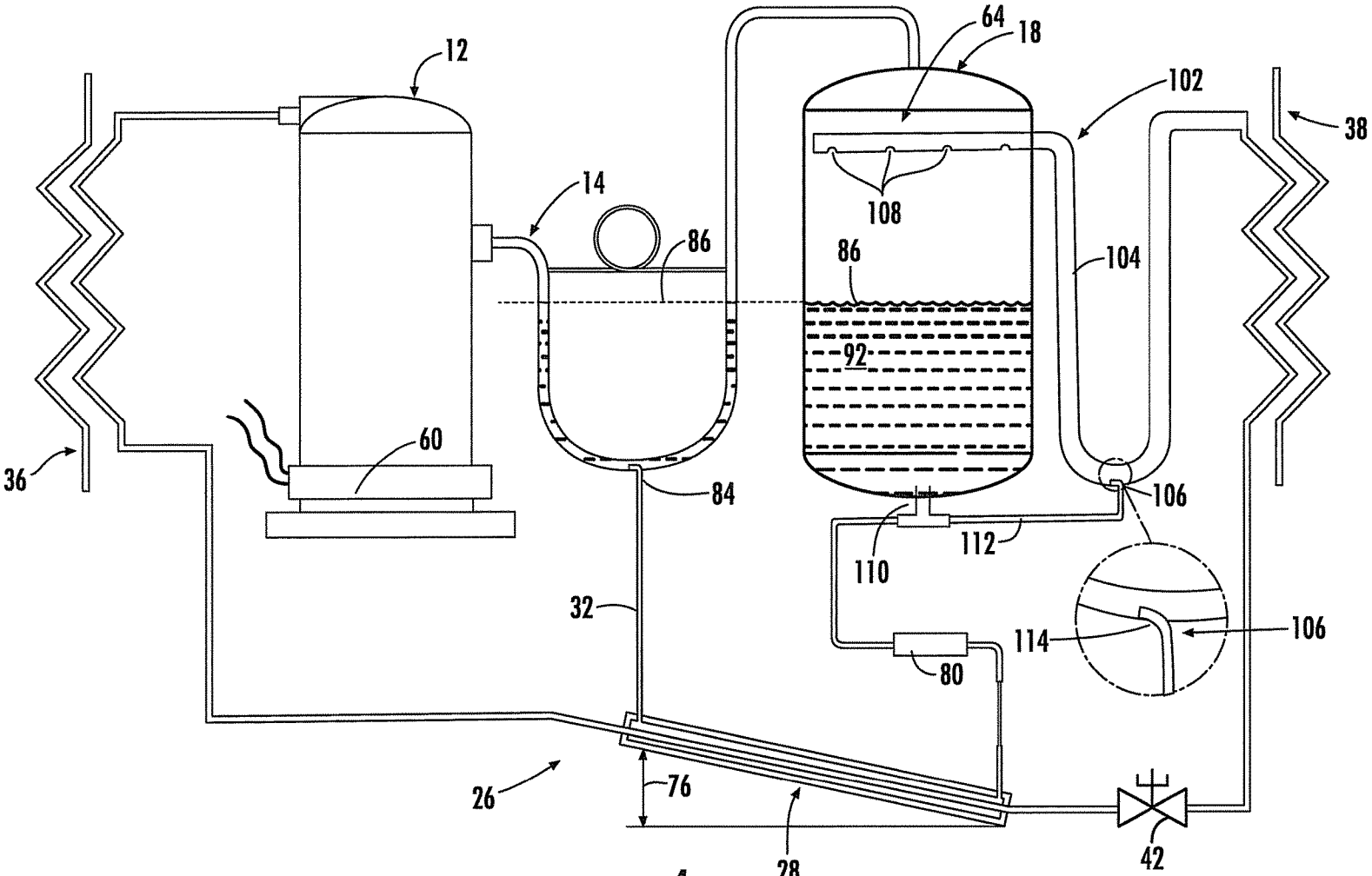

With reference now to FIG. 4, the lubricant (oil) return mechanism 26 as above described with reference to FIG. 3 is illustrated with a further simplification of the ACC 18 also illustrated by way of example. An evaporator tube 102 that formed a portion of the ACC inlet tube 64 within the ACC for the embodiment of FIG. 3, is now removed from the ACC 18 and a portion 104 of the evaporator tube 102 from the evaporator 38 remains outside the ACC 18. The portion 104 extends from an inlet port 106 to outlet holes 108 within that portion of the evaporator tube 102 positioned within the ACC 18 and forming the ACC inlet tube 64. The ACC 18 is now simply a reservoir for the liquid refrigerant/oil mix 92. However, an outlet 110 of the ACC 18, tube 112, Venturi 114, the evaporator tube portion 104 and the outlet holes 108 continue to provide the function of an ACC, as above described.

Figure 5:
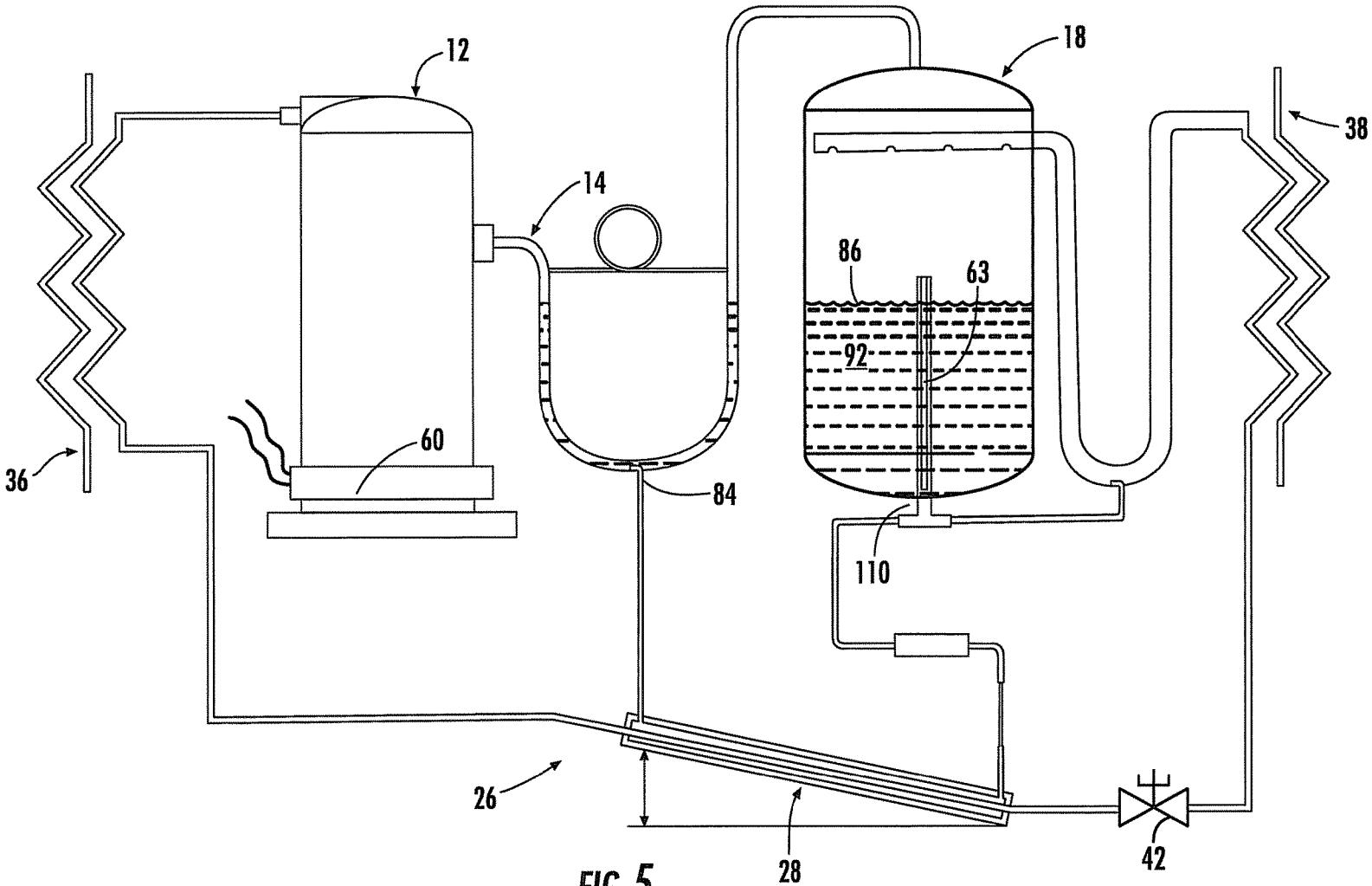

As above described with reference to FIG. 1, and as now further illustrated with reference to FIG. 5, the lubricant return mechanism 26 may comprise the slots 63 within the outlet tube 62 of the ACC 18. As further illustrated with reference to FIG. 5, the slots 63 may extend to a point above the normal liquid level 86. The slot 63 serves to collect oil from any stratified layer of oil floating on top of a saturated refrigerant/oil mix 92, thereby increasing the rate of oil return to the compressor 12.

Figure 6:
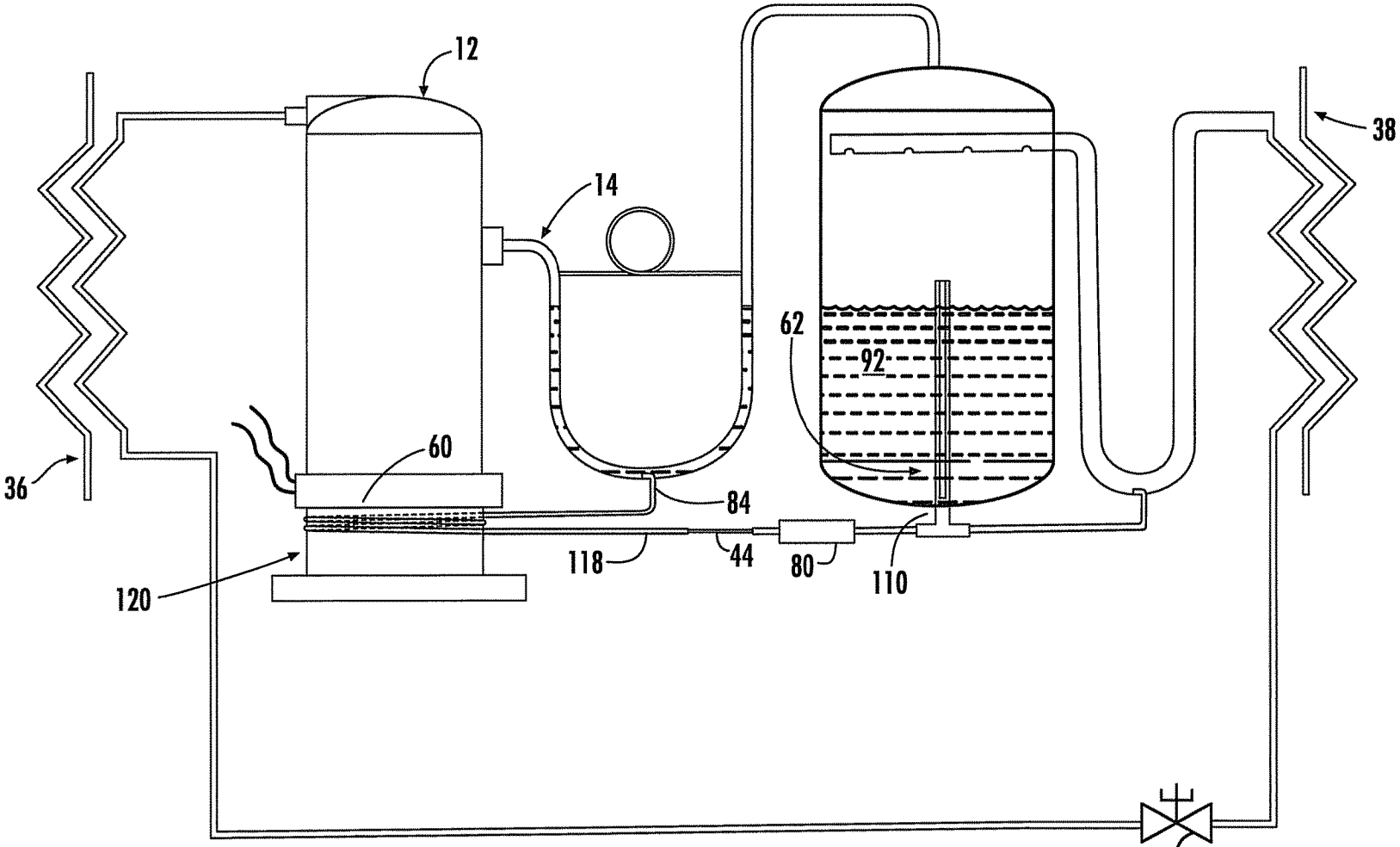

With reference to FIG. 6, yet another embodiment of the invention may exclude the heat exchanger 28 as above described with reference to FIGS. 1, 3, 4 and 5, and places the bottom of the ACC 18 at the outlet 110 in fluid communication with the inlet port 84 the compressor inlet 14. A single tube 118 may connect the outlet 110 with the inlet 84. The strainer 80 and restrictor 44 may be included as shown, and convey a portion of the fluid mix 92 to the compressor 12. The path of the tube 118 encircles the compressor 12 sufficient for placing the tube 118 in thermal contact with the compressor, forming a heat exchanger 120. Thus, heat from the compressor 12 evaporates the refrigerant flowing through tube 118, thereby delivering refrigerant vapor and compressor oil to the inlet 84, and on to the compressor 12 via the compressor inlet 14, as above described.

Figure 7:
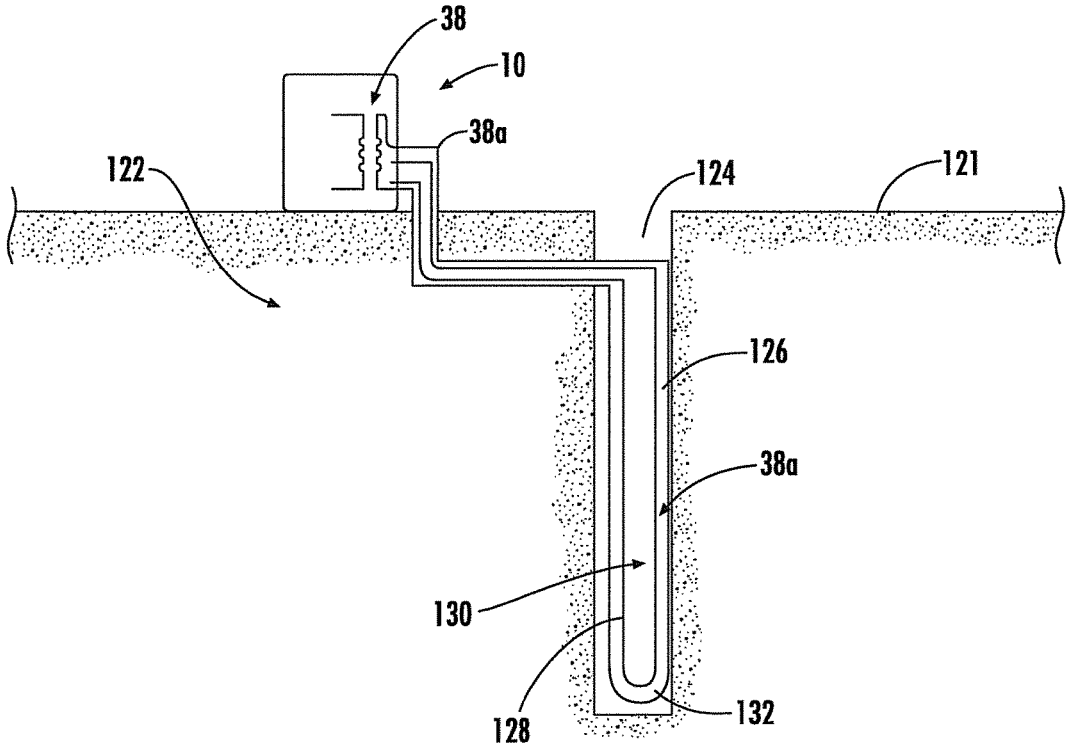
FIG. 7 is a diagrammatical illustration of an earth linked embodiment for a condenser in keeping with the teachings of the present invention.

As above described with reference to embodiments of the invention, by way of example to FIG. 1, and now with reference to FIG. 7, it is to be understood that while the evaporator 38 is herein illustrated as a heat exchanger, such illustration is also intended that the evaporator may alternatively comprise at least one earth loop conduit 38*a* extending from a surface of the earth 121 down into the earth 122 in a trench, pit or borehole 124, body of water, and the like. The borehole 124 may generally include two side-by-side conduits 126, 128 extending into the borehole as an earth loop 130 in fluid communication at distal ends 132 of the conduits 126, 128. By way of example, the conduit 126 is herein illustrated as a vapor line, and the conduit 128 herein illustrated as the liquid line. Such an earth linked structure may also be the case for the condenser 36.

Many modifications and other embodiments of the invention will come to the mind of one skilled in the art having the benefit of the teachings presented in the foregoing descriptions and the associated drawings and photos. Therefore, it is to be understood that the invention is not to be limited to the specific embodiments disclosed, and that modifications and alternate embodiments are intended to be included within the scope of the claims supported by this specification.

The invention claimed is:

1. A refrigeration system comprising:

a compressor for compressing a refrigerant with a lubricant entrained therein, the compressor having a compressor inlet and a compressor outlet;

an active charge control (ACC) enclosing an interior volume in which the refrigerant in a liquid phase is held up to a liquid level, above which liquid level the refrigerant in the ACC is in a vapor phase, the ACC having an ACC inlet and an ACC outlet;

a compressor inlet conduit having an ACC end receiving the refrigerant from the ACC outlet and a compressor end delivering the refrigerant to the compressor inlet, the ACC and compressor ends being above the liquid level of the ACC and a lower portion therebetween being below the liquid level of the ACC; and a lubricant return line having a first end receiving the refrigerant from the ACC below the liquid level and a second end delivering the refrigerant to the lower portion of the compressor inlet conduit.

2. The system of claim 1, further comprising a lubricant return heating mechanism for vaporizing the refrigerant in the lubricant return line before being delivered to the lower portion of the compressor inlet conduit.

3. The system of claim 2, wherein the lubricant return heating mechanism includes a heat exchanger having a primary pathway of the refrigerant exiting the compressor outlet and a secondary pathway of the refrigerant in the lubricant return line.

4. The system of claim 1, wherein the lubricant return line is dimensioned such that less than five percent of the refrigerant traversing the system flows therethrough.

5. The system of claim 4, wherein the lubricant return line is dimensioned such that one to three percent of the refrigerant traversing the system flows therethrough.

6. The system of claim 1, further comprising a vent tube connected between the ACC end and the compressor end of the compressor inlet conduit above the liquid level of the ACC.

7. The system of claim 1, further comprising a heater connected to the compressor and configured to operate during compressor off-cycles to maintain the compressor warmer than the ACC.

8. The system of claim 1, further comprising:

a condenser receiving the refrigerant from the compressor outlet; and an evaporator receiving the refrigerant from the condenser and delivering it to the ACC inlet.

9. The system of claim 8, further comprising at least one of the condenser and the evaporator includes at least one looped conduit extending into the earth.

10. The system of claim 8, further comprising a fluid control device connected between the condenser and the evaporator.

* * * * *